US010969174B2

(12) United States Patent
Provoost et al.

(10) Patent No.: US 10,969,174 B2
(45) Date of Patent: Apr. 6, 2021

(54) ROASTING FURNACE, USE THEREOF AND METHOD FOR THE PROCESSING OF ORES OR CONCENTRATES

(71) Applicant: SADACI NV, Ghent (BE)

(72) Inventors: Guido Provoost, Ghent (BE); Tom Eggermont, Ghent (BE)

(73) Assignee: SADACI NV, Ghent (BE)

( * ) Notice: Subject to any disclaimer, the term of this patent is extended or adjusted under 35 U.S.C. 154(b) by 71 days.

(21) Appl. No.: 16/099,605

(22) PCT Filed: May 24, 2017

(86) PCT No.: PCT/EP2017/062539
§ 371 (c)(1),
(2) Date: Nov. 7, 2018

(87) PCT Pub. No.: WO2017/202909
PCT Pub. Date: Nov. 30, 2017

(65) Prior Publication Data

US 2019/0145707 A1 May 16, 2019

(30) Foreign Application Priority Data

May 27, 2016 (BE) ..... BE2016/0089

(51) Int. Cl.
*F27B 9/00* (2006.01)
*F27B 9/18* (2006.01)
(Continued)

(52) U.S. Cl.
CPC ..... *F27B 9/185* (2013.01); *C22B 1/02* (2013.01); *C22B 34/34* (2013.01)

(58) Field of Classification Search
CPC ... F27B 9/185; F27B 1/02; C22B 1/02; C22B 34/34
See application file for complete search history.

(56) References Cited

U.S. PATENT DOCUMENTS 2,210,479 A * 8/1940 Booton ..... C22B 1/02 423/1
4,034,969 A 7/1977 Grimes

FOREIGN PATENT DOCUMENTS

GB 191308635 A 4/2014

OTHER PUBLICATIONS

International Preliminary Report on Patentability (PCT/IPEA/409) issued in PCT/EP2017/062539, dated May 4, 2018.
(Continued)

*Primary Examiner* — Scott R Kastler
(74) *Attorney, Agent, or Firm* — Birch, Stewart, Kolasch & Birch, LLP

(57) ABSTRACT

A roasting furnace for processing ores or concentrates, preferably molybdenum-containing ores or concentrates is described. The roasting furnace contains at least one first rotary lifting system for the displacement of said arm along the axis direction, wherein said first rotary lifting system is a telescopic lifting system, and/or wherein a distance x between two consecutive said stages of said roasting furnace are at least 1.000 m, wherein said distance x is measured along the axis direction. The roasting furnace of has an improved processing capacity and/or a reduction in the number of halts, and consequently is more energy-efficient, more environmentally-friendly and more economically interesting.

14 Claims, 3 Drawing Sheets

(51) Int. Cl.
*C22B 34/34* (2006.01)
*C22B 1/02* (2006.01)

(56) References Cited

OTHER PUBLICATIONS

International Search Report (PCT/ISA/210) issued in PCT/EP2017/062539, dated Aug. 9, 2017.
Written Opinion (PCT/ISA/237) issued in PCT/EP2017/062539, dated Aug. 9, 2017.

* cited by examiner

ROASTING FURNACE, USE THEREOF AND METHOD FOR THE PROCESSING OF ORES OR CONCENTRATES

FIELD OF THE TECHNOLOGY

The present invention relates to a roasting furnace, the use of the roasting furnace and a method for the processing of ores or concentrates, preferably molybdenum-containing ores or concentrates.

STATE OF THE ART

It is well known that ores or concentrates, preferably molybdenum ($MoS_2$) concentrates, can be processed into roasted molybdenum concentrate by roasting said molybdenum-containing ores or concentrates. With said roasted molybdenum concentrate or technical molybdenum oxide is meant matter as described by the "REACH Molybdenum Consortium" (RMC Sub Id & Classif. 2015).

The roasting is typically done in a roasting furnace with multiple hearths ("multiple-hearth"), wherein said roasting furnace is often of the Nichols-Herreshoff type. Other roasting furnace types, e.g. rotary tube furnaces, perform less than said multiple-hearth roasting furnaces and are therefore less frequently used.

The use of multiple hearths within a roasting furnace allows for different partial reactions of the conversion process to be carried out in specific zones of the roasting furnace, such that molybdenite concentrate is roasted to roasted molybdenum concentrate or technical molybdenum oxide.

"Multiple-hearth" roasting furnaces, used in the prior art, e.g. U.S. Pat. No. 7,735,434 B2, for the roasting of molybdenite concentrates, contain in addition to stages, a shaft, arms that are attached to the shaft, and teeth that are attached to said arms. The distance between consecutive stages is typically less than 0.995 m. During the roasting process, the shaft produces a rotary motion by means of controlling rotary means at the bottom of the shaft, wherein the teeth rake the material on the hearth stage ("bed of material") and provide a radial displacement of this material. Through cavities at the edge of the hearth stage, the material is displaced from hearth stage to hearth stage. "Multiple-hearth" roasting furnaces often also contain a lifting system ("jacking system") under the shaft which allows the teeth to be lifted up a few centimeters (typically up to 0.020 to 0.030 m), when the shaft is optionally rotating.

In spite of the fact that much is already known in the prior art regarding the roasting process of molybdenum-containing ores or concentrates in "multiple-hearth" roasting furnaces, the said type of roasting furnaces as described in the prior art still experience a number of shortcomings. Disadvantages of the state of the art include, amongst others, a limited efficiency of the roasting furnace, mechanical wear of roasting furnace components, a difficult to control temperature gradient from hearth stage to hearth stage (partly due to uneven heat distribution in the roasting furnace), and the formation of hard crusts of sintered molybdates and oxides during the roasting. These crusts adhere to surfaces in the roasting furnace, e.g. stages, shaft, walls, arms and teeth, and can lead to a mechanical blockage of the rotary shaft. The teeth then get stuck in the sintered material which results in a complete halt of the roasting furnace and a sintering of the remaining material. In addition, the hard crust leads in the long term to erosion and wear of the optionally moving parts in the roasting furnace.

Because said lifting system below the shaft allows only for a limited vertical displacement of the teeth (typically up to 0.020 to 0.030 m), removal of the said hard crust can only be done optimally when the roasting furnace is not working. This limitation results in frequent and long-term halts of the roasting furnace. In addition, a restart of the roasting furnace also requires a lot of energy. A use of the lifting system during the rotation of the roasting furnace increases the risk of tooth breaking of the gears that are part of the rotary means.

Accordingly, the present state of the art does not provide "multiple-hearth" roasting furnaces, as described above, with a greater distance between consecutive stages and/or which allow higher efficiency to be obtained, removal of hard crusts from the walls and stages during the rotating of the shaft, lifting the teeth over a larger distance from the bed of material and/or being less harmful to the environment as a consequence of a halt.

SUMMARY

The present invention seeks to provide a roasting furnace of said type with an improved processing capacity (Cap, expressed in $kg/m^2$ per day) and/or a reduction of the number of halts, and is consequently more energy-efficient, more environmentally friendly and more economically more interesting.

Indeed, according to a first aspect, the present invention provides a roasting furnace for processing ores or concentrates, preferably molybdenum-containing ores or concentrates, wherein said roasting furnace contains a shaft, an upper part and a lower part, wherein said upper part and said lower part are separated by a bottom floor, wherein said upper part contains an outer wall (4), at least one first type of hearth stage, at least one second type of hearth stage, and at least one arm, wherein said arm contains at least one tooth, wherein said arm is connected to said shaft, wherein said lower part contains rotary means and a bearing block, wherein said bearing block is located under said shaft, wherein at least one first rotary lifting system is contained in said roasting furnace for the displacement of said arm along the axis direction, and/or wherein a distance x between two consecutive said stages is at least 1.000 m, wherein said distance x is measured along the axis direction.

An advantage is that, during the operation of the roasting furnace, and thus during the optional rotation of the shaft, the first rotary lifting system can cause a displacement of the arms. As a result, the teeth can be completely or partially removed from the bed of material. Consequently, the roasting furnace may optionally be evacuated of sintered material while the arms make a rotary motion. This invention also allows the teeth to gradually move into or out of the bed of material, thereby dramatically reducing or possibly avoiding the risk of mechanical blockage. An additional advantage is the increase in processing capacity (Cap) of the roasting furnace due to the greater distance x between two consecutive stages than in current "multiple-hearth" roasting furnaces, known in the prior art, provided that all other process parameters and characteristics of the furnaces do not differ.

In a particular embodiment of the invention, a first non-rotary lifting system is contained in said roasting furnace for the displacement of said arm along the axis direction, wherein said first non-rotary lifting system is preferably attached below said shaft.

In a particular embodiment of the invention the first rotary lifting system is contained in the shaft.

An advantage is that fewer adjustments have to be made for the installation of the first rotary lifting system in an existing roasting furnace. In addition, this particular embodiment allows a relatively simple configuration of the roasting furnace wherein the lifting process of the arms can take place during a rotation of the shaft.

In a particular embodiment of the invention, the distance x between two consecutive stages is at least 1.180 m, preferably at least 1.320 m.

An advantage of this greater distance compared to roasting furnaces as described in the prior art, wherein the distance between the stages x is less than 1.000 m, is an increase of the processing capacity (Cap) of the roasting furnace, provided that all other process parameters and characteristics of the roasting furnaces do not differ.

In a particular embodiment of the invention, said upper part of the roasting furnace and said lower part of the roasting furnace contain at least one said first rotary lifting system.

In a particular embodiment of the invention, said first rotary lifting system is a telescopic lifting system.

In a particular embodiment of the invention, said telescopic lifting system contains at least one lifting mechanism and at least one slide contact.

An advantage is that the telescopic lifting system allows a controlled displacement of the teeth out of or into the bed of material, despite the heavy mass of the shaft.

In a particular embodiment of the invention, at least one of said first rotary lifting systems is contained in said lower part or said upper part, preferably in between said rotary means and said bottom floor.

In a particular embodiment of the invention, said displacement of the arms is an upward displacement if the distance z between said arm and said bottom floor increases.

In a particular embodiment of the invention, said displacement is a downward displacement if the distance z between said scraper arm and said type of bottom floor decreases.

In a particular embodiment of the invention, said upward displacement or said downward displacement of said arm along the axis direction is in the range [0.000 m, y m], wherein y is at least equal to said distance x reduced by the sum of the thickness of said hearth stage, the thickness of the said arm and the thickness of said tooth, wherein said thicknesses are measured along the axis direction.

This upward and or downward displacement allows the teeth to be partially or completely displaced out of the bed of material. It is an advantage that the shaft may continue to rotate regardless of the level of sintering of the bed of material.

In a particular embodiment of the invention, said first type of hearth stage and said second type of hearth stage are connected to said outer wall by support means, wherein said support means are disposed in said outer wall.

In a particular embodiment of the invention, a distance x' is the distance between two consecutive said support means, wherein x' is measured along the axis direction, and wherein said distance x' is at least 1.000 m.

In a particular embodiment of the invention, said distance x' is at least 1.180 m, preferably 1.320 m.

The advantage of this greater drop height between two consecutive stages of a roasting furnace according to said embodiment as compared to roasting furnaces, described in the prior art, is an increase in the processing capacity (Cap) provided that the other process parameters and characteristics of the roasting furnace do not differ.

According to a second aspect of the invention, a use of a roasting furnace according to the invention is provided for the processing of ores or concentrates, preferably molybdenum-containing ores or concentrates.

In a particular embodiment of a use of the roasting furnace according to the invention, the displacement of the arms occurs during the optional rotation of the shaft.

In accordance with a preferred embodiment of a method for the processing of molybdenum-containing ores or concentrates according to the invention, the characteristic should contain the following steps:

a. producing technical molybdenum oxide (RMC) by the use of a furnace;
b. producing ferromolybdenum products by the use of said technical molybdenum oxide (RMC);
c. producing a pure oxide by the use of said technical molybdenum oxide (RMC);
d. producing ammonium salts of molybdenum by the use of said technical molybdenum oxide (RMC), wherein said furnace is a roasting furnace according to any of the foregoing aspects or particular embodiments.

In a particular embodiment of a method according to the invention, pure oxide contains at least 99% molybdenum trioxide ($MoO_3$).

In a particular embodiment of the method according to the invention, the processing capacity (Cap, expressed in $kg/m^2 \cdot day$) of the roasting furnace is at least 20% higher, compared to roasting furnaces known in the prior art, provided that all other process parameters and roasting furnace characteristics are the same.

BRIEF DESCRIPTION OF THE FIGURES

With the objective to better demonstrate the characteristics of the invention, hereinafter, by way of example without a restrictive nature, a preferred embodiment of a roasting furnace according to the present invention is described, with reference to the accompanying drawings, wherein.

DETAILED DESCRIPTION

Figure 1:
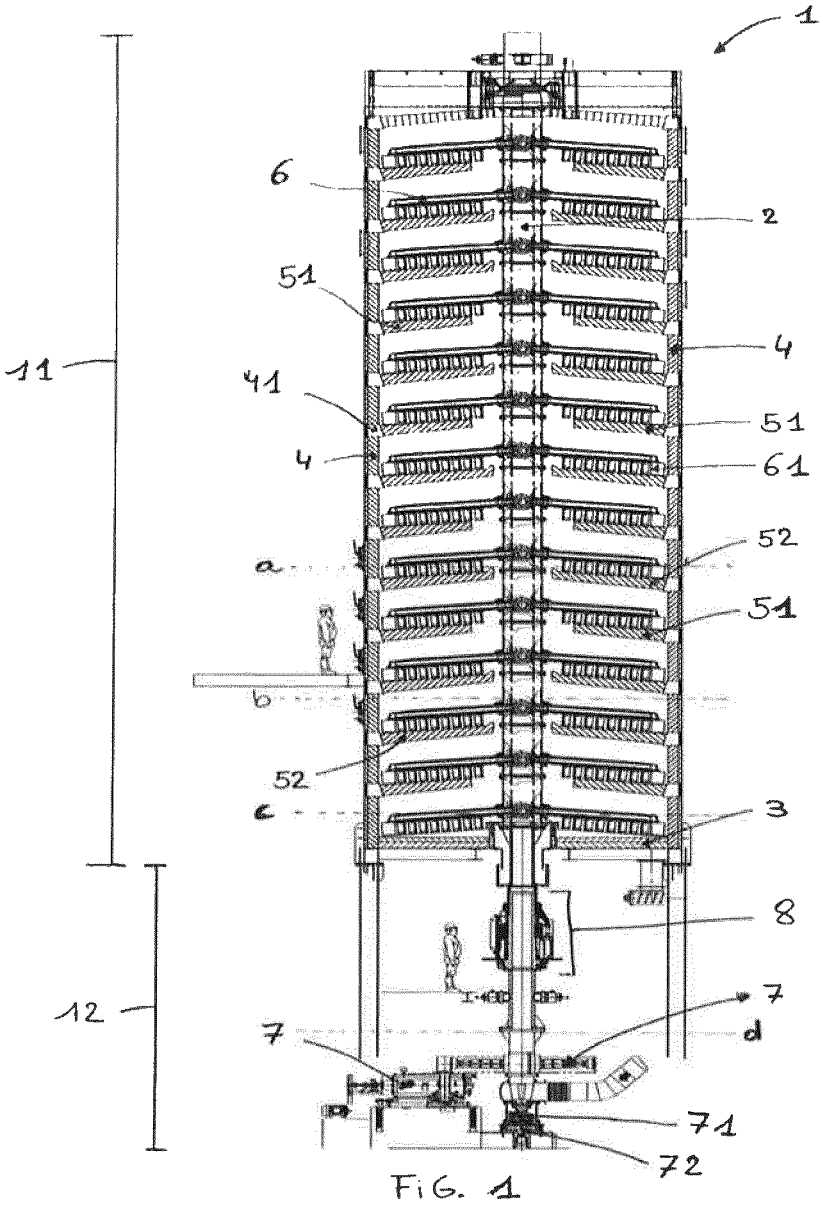
FIG. 1 is an illustration of a vertical cross section of a roasting furnace according to an aspect of the invention.

In FIG. 1 a preferred embodiment of a roasting furnace 1 according to the present invention is illustrated. The roasting furnace 1 is used to process ores or concentrates, preferably molybdenum-containing ores or concentrates such as molybdenite ($MoS_2$). This molybdenite is placed on the furnace as a concentrate after a flotation process in which molybdenum is concentrated from ores. The roasting furnace contains an upper part 11 and a lower part 12, wherein the upper part 11 and the lower part 12 are separated by a bottom floor 3. The roasting furnace furthermore contains a shaft 2 which connects the upper part 11 and the lower part 12 of the furnace with each other through an opening in said bottom floor 3.

The upper part 11 contains an outer wall 4, at least 1 first type of hearth stage 51, at least 1 second type of hearth stage 52, and at least 1 arm 6. The arm contains at least 1 tooth 6 and is connected with the shaft 2. The lower part of the roasting furnace contains rotary means 7, and a bearing block 71 below the shaft 2. Furthermore, the roasting furnace contains at least a first rotary lifting system 8 for the displacement of the arms along the axis direction, and/or the distance x between two consecutive stages 51 52 is at least 1.000 m, preferably at least 1.180 m, in particular at least 1.320 m.

Said bearing block contains an axial and radial bearing.

According to a preferred embodiment of the invention, the roasting furnace contains a first non-rotary first lifting system 72 which is attached below the bearing block 71.

The bottom floor 3 has a circular horizontal cross section with an opening connecting the upper circle surface to the lower circle surface and which contains the center of this imaginary circle. The bottom floor 3 is preferably made of refractory material. However, the shape and the material of the bottom floor are not limited to said form and said material.

The bottom floor 3 divides the roasting furnace 1 into an upper part 11 and a lower part 12. The roasting furnace shaft 2 is preferably centrally located in the roasting furnace 1 and passes through the opening in the bottom floor 3 of the lower part 12 to the upper part 11 of the furnace 1. The shaft 2 is a cylinder preferably made of steel. However, the shape of the shaft and the material of the shaft are not limited to said shape and said material.

The shaft 2 is driven by rotary means 7. These rotary means 7 are preferably coupled gears wherein the rotary motion of the guide gear provides a rotary motion with the next gear. However, the rotary means are not limited to said rotary means.

The arms 6 are directly attached to the shaft 2 and consequently follow the movement of the shaft. On the arms 6 teeth 61 are located which are attached for raking the material located on the stages 51 52 (bed of material). If the shaft rotates and if the teeth are in contact with the material on the stages, the teeth allow for a radial displacement of the material in the bed of material to the drop hole of the hearth stage, causing the material to be displaced using the gravity of the first type of hearth stage 51 to the second type of hearth stage 52 or vice versa.

The outer wall 4 of the roasting furnace 1 contains openings containing support elements 41, preferably a mother stone, on which the stages 51 52 rest. The roasting furnace as described above contains two different stages depending on the position of the drop holes. A first type of hearth stage 51 contains a concentric drop hole at the shaft 2 while a second type of hearth stage 52 contains at least one drop hole at the outer wall 4.

Preferably, the roasting furnace contains a configuration of stages wherein a first type of hearth stage 51 is alternated by a second type of hearth stage 52, etc. This causes the material to fall from a first type of hearth stage 51 to a second type of hearth stage 52 and vice versa. However, the configuration of the roasting furnace is not limited to the above configuration.

Figure 3:
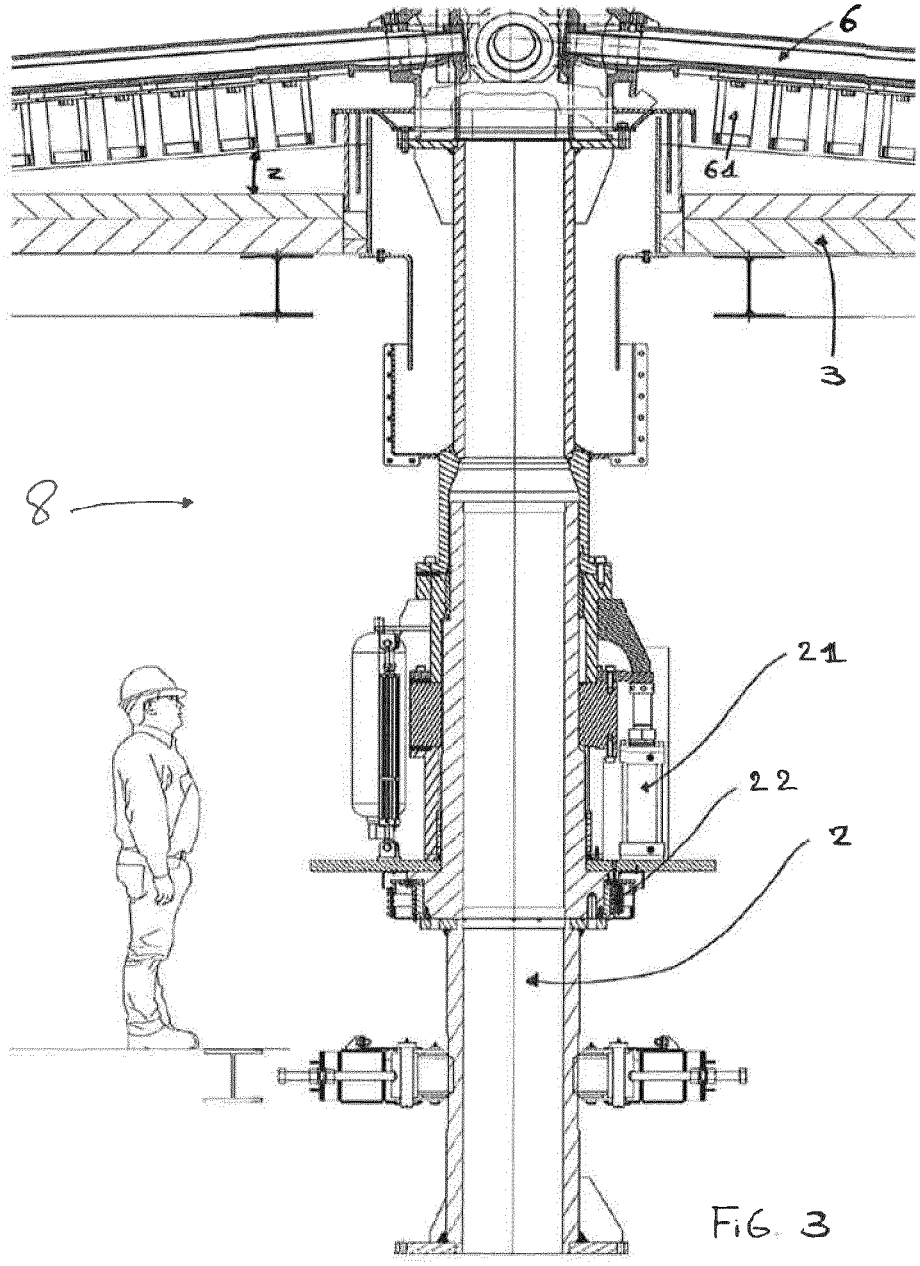
FIG. 3 is a section of a vertical cross section of a roasting furnace between lines c and d according to FIG. 1.

The first rotary lifting system 8 for the displacement of the arms along the axis direction is preferably a telescopic lifting system which is contained in the shaft 2, preferably in the lower part 12 or the upper part of the roasting furnace 11. The first rotary lifting system contains at least a lifting mechanism 21, preferably a hydraulic pump. Any other type of lifting mechanism provided for allowing a displacement of the arms during the optional rotating of the shaft, may however be used, for example at least one electric motor reductor. The first rotary lifting system contains at least one slide contact 22, as illustrated in FIG. 3. The slide contact preferably contains 6 carbon brushes. However, the material from which the slide contact is constructed and the number of brushes it contains is not limited to said material and number.

Figure 2:
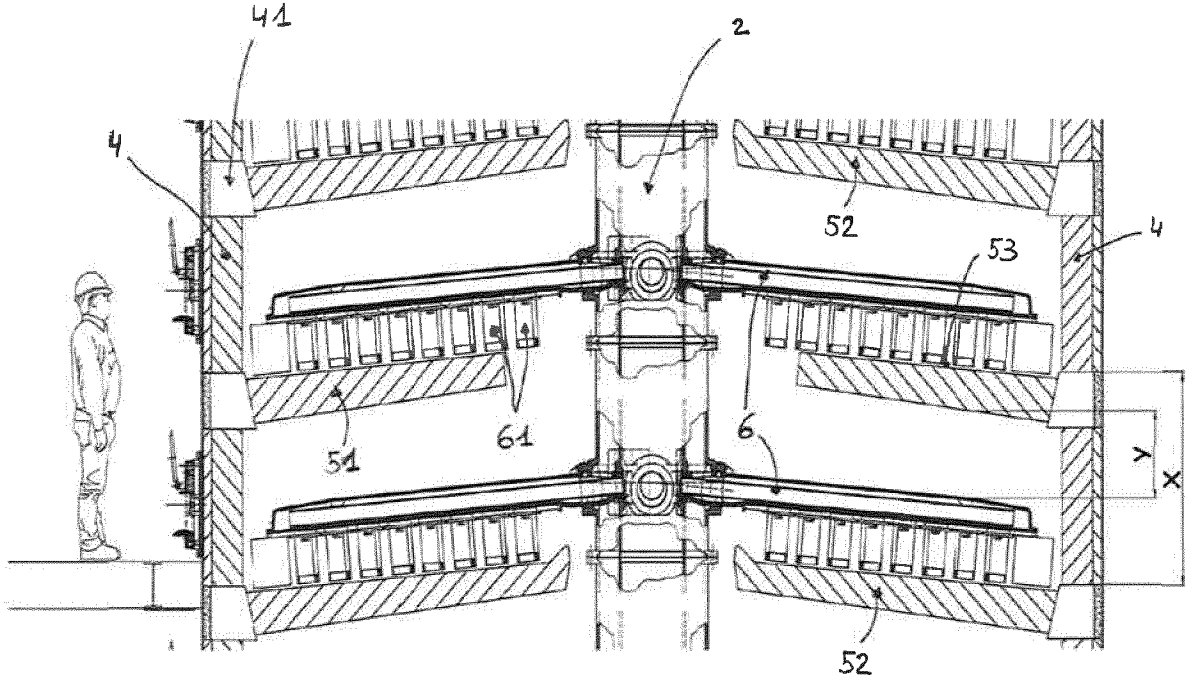
FIG. 2 is a section of a vertical cross section of a roasting furnace between lines a and b according to FIG. 1.

As illustrated in FIG. 2, the distance x between two consecutive stages 51 52 is measured along the axis direction, and from the upper side of the hearth stage 51 52 to the upper side of the next hearth stage 51 52. Thus, the distance x is measured parallel or collateral to the shaft 2, wherein an imaginary straight r (not shown) which connects the start and end point of the distance x, and an imaginary straight r' (not shown) which runs collateral to the shaft 2, are collateral and located in the same plane. Preferably, the distance x is measured as close as possible to the outer wall 4 of the roasting furnace. The distance x' (not shown) is the distance between 2 consecutive support means measured along the axis direction and between similar reference points of the support means, for example from upper surface to upper surface.

An embodiment of the roasting furnace 1 according to the invention may also contain a first rotary lifting system 8 in the upper part 11 and in the lower part 12 of the shaft 2 (not shown). Preferably, both first rotary lifting systems 8 are placed in the shaft 2 and in such a way that they can operate independently. The placing of multiple first rotary lifting systems 8 in the upper part 11 of the shaft 2 and in particular between different stages 51 52, allows for different upward or downward displacement of the arms 6 at the same time.

Referring to FIG. 3, the difference between an upward and downward displacement is determined on the basis of the distance z between an arm 6 and the bottom floor 3, wherein z is measured between a point o (not shown) on the lower part of an arm 6 and a point o' (not shown) on the bottom floor 3, wherein o' is the point determined by a line parallel to the shaft containing the point o. Consequently, z is also measured along the axis direction. If said distance z is increased by operating a first non-rotary lifting system 72 and/or by operating a first rotary lifting system 8, then the displacement of the arm 6 is an upward displacement. If said distance z becomes smaller by operating a first non-rotary lifting system 72 and/or by operating a first rotary lifting system 8, then the displacement of the arm 6 is an upward displacement.

The upward or downward displacement of the arms 6 is located in the range [0.000 m, y m], where y is at least equal to said distance x reduced by the sum of the thickness of said hearth stage 51 52, the thickness of the said arm 6 and the thickness of said tooth 61, wherein said thicknesses are measured along the axis direction, wherein the principle along the axis direction has been described before. The displacement of the arms allows the teeth 61 to be at least partially displaced into or out of the bed of material.

For a description of the processing of molybdenum-containing ores or concentrates, we mean a processing process as described in the following reference "Ullmann's Encyclopedia of Industrial Chemistry, Volume A16 (Magnetic Materials to Mutagenic Agents), p 655-698 (Molybdenum and Molybdenum Compounds); more specifically p 661-663 (Processing of Concentrate)" and references therein.

According to a preferred embodiment of a method for the processing of molybdenum-containing ores or concentrates according to the invention, the method contains the following steps:

a. producing technical molybdenum oxide (RMC) by the use of a furnace;
b. producing ferromolybdenum products by the use of said technical molybdenum oxide (RMC);

c. producing a pure oxide by the use of said technical molybdenum oxide (RMC);

d. producing ammonium salts of molybdenum by the use of said technical molybdenum oxide (RMC), wherein said furnace is a roasting furnace according to any of the foregoing embodiments of the invention.

The molybdenum oxide resulting from step a. of said method is optionally compacted, preferably converted into a briquette or packaged.

Ferromolybdenum is an iron-molybdenum alloy with a molybdenum content between 40%-75% which dissolves faster in steel melt than pure metallic molybdenum. For the production of ferromolybdenum, technical molybdenum oxide is reduced in a metallothermal process. Usually, silicon is used as a reductor, which is added in the form of ferrosilicon.

The produced technical molybdenum oxide according to said method may also be chemically purified to a pure oxide. This pure oxide may, amongst others, be used in catalysts. To be pure, the oxide should contain at least 99% molybdenum trioxide ($MoO_3$).

The processing capacity (Cap) of the roasting furnace is expressed as the amount of molybdenum (in kg) that can be processed per total surface of the roasting furnace 1, expressed in $m^2$, and per day. The total surface of roasting furnace 1 is the sum of the upper surface 53 of the stages in the roasting furnace 1. According to an embodiment of the method according to the invention, the roasting furnace 1 has a processing capacity that is 20% higher compared to roasting furnaces known in the state of the art, provided all other process parameters and roasting furnace characteristics are the same. With all other process parameters and roasting furnace characteristics, reference is made to all process parameters and roasting furnace characteristics except for the distance x between two consecutive said stages, wherein said distance x is measured along the axis direction. In a particular embodiment of the method according to the invention, wherein the distance x for the roasting furnace is in the range [1.100 m, 1.400 m], the processing capacity is at least 25% higher as compared to roasting furnaces known in the prior art wherein distance x is up to 0.995 m, provided all other process parameters and roasting furnace characteristics are the same.

From the above description it follows that with the optional functioning of the roasting furnace, and thus during the optional rotating of the shaft, the first rotary lifting system can provide for a displacement of the arms. As a result, the teeth can be completely or partially removed from the bed of material. As a consequence, the roasting furnace can be evacuated of sintered material while the arms make an optional motion. This invention also allows the teeth to move gradually into or out of the bed of material thereby reducing and possibly eliminating the risk of mechanical blockage. An additional advantage is the increase in processing capacity of the roasting furnace due to the greater distance x between two consecutive stages than in current "multiple-hearth" roasting furnaces known from the prior art.

The invention claimed is:

1. A roasting furnace for the processing ores or concentrates, comprising:

a shaft extending in an axis direction;

an upper part; and a lower part, wherein said upper part and said lower part are separated by a bottom floor, wherein said upper part, contains an outer wall, at least one first hearth stage, at least one second hearth stage, and at least one arm, wherein said arm contains at least one tooth, wherein said arm is connected to said shaft, wherein said lower part contains a rotary mechanism and a bearing block, wherein said bearing block is located under said shaft, wherein at least one first rotary lifting system is contained in said roasting furnace for the displacement of said arm along the axis direction, wherein said first rotary lifting system is a telescopic lifting system, and wherein a distance x between two consecutive said stages is at least 1.000 m, wherein said distance x is measured along the axis direction.

2. The roasting furnace according to claim 1, wherein a first non-rotary lifting system is contained in said roasting furnace for the displacement of said arm along the axis direction, wherein said first non-rotary lifting system is attached below said shaft.

3. The roasting furnace according to claim 1, wherein said first rotary lifting system is contained in said shaft.

4. The roasting furnace according to claim 1, wherein said distance x between two consecutive said stages is at least 1.180 m.

5. The roasting furnace according to claim 1, wherein said upper part and said lower part contain at least one said first rotary lifting system.

6. The roasting furnace according to claim 5, wherein said telescopic lifting system contains at least one lifting mechanism and at least one slide contact.

7. The roasting furnace according to claim 1, wherein at least one of said first rotary lifting system is contained in said lower part, or said upper part, between said rotary mechanism and said bottom floor.

8. The roasting furnace according to claim 1, wherein said first rotary system allows an upward displacement of said arm along the axis.

9. The roasting furnace according to claim 1, wherein said first rotary system allows a downward displacement of said arm along the axis.

10. The roasting furnace according to claim 1, wherein said first hearth stage and said second hearth stage are connected to said outer wall by a support, wherein said support is disposed in said outer wall.

11. The roasting furnace according to claim 10, further containing a distance x', wherein x' is the distance between 2 consecutive said supports measured along the axis direction, and wherein said distance x' is at least 1.000 m.

12. The roasting furnace according to claim 11, wherein said distance x' is at least 1.180 m.

13. The roasting furnace according to claim 1, wherein said distance x between two consecutive said stages is at least 1.320 m.

14. The roasting furnace according to claim 2, wherein said first rotary lifting system is contained in said shaft.

* * * * *